US006092482A

United States Patent [19]

Danenbarger

[11] Patent Number: 6,092,482

[45] Date of Patent: Jul. 25, 2000

[54] ANCHOR AND MOORING ANTI-CHAFE ARRANGEMENT

[76] Inventor: John Danenbarger, 1 Broad St., Unit #9, Salem, Mass. 01970

[21] Appl. No.: 09/236,000

[22] Filed: Jan. 22, 1999

[51] Int. Cl.[7] ..... B63B 21/00

[52] U.S. Cl. ..... 114/230.2; 114/230.26

[58] Field of Search ..... 114/230.1, 230.2, 114/230.25, 230.26, 293; 59/93

[56] References Cited

U.S. PATENT DOCUMENTS

| | | | |
|---|---|---|---|
| 131,803 | 10/1872 | Winger . | |
| 655,155 | 7/1900 | Littlepage . | |
| 1,083,478 | 1/1914 | Arbon . | |
| 1,244,043 | 10/1917 | Euler . | |
| 1,537,876 | 5/1925 | Pirdun . | |
| 1,767,432 | 6/1930 | Caulkins . | |
| 2,485,445 | 10/1949 | Hoffman | 24/135 |
| 2,607,094 | 8/1952 | Nicosia | 24/123 |
| 3,055,333 | 9/1962 | Ryan | 114/230.2 |
| 3,842,780 | 10/1974 | Allens et al. | 114/230 |
| 4,493,134 | 1/1985 | Karr | 24/132 WL |
| 5,212,939 | 5/1993 | Pratt, Jr. | 59/93 |
| 5,711,243 | 1/1998 | Dunham | 114/230.2 |
| 5,806,452 | 9/1998 | Benoit | 114/218 |

*Primary Examiner*—Stephen Avila

[57] ABSTRACT

The invention is an anti-chafing device for use with an anchor line attached to a boat. The device comprises a housing arranged to secure about a portion of the anchor line, and a connector is arranged between the housing and the boat to secure the anchor line and the housing to the boat. Force exerted by the anchor line will be transmitted through the housing and the connector to the boat, thereby eliminating chafing on the anchor line by the boat.

11 Claims, 2 Drawing Sheets

ANCHOR AND MOORING ANTI-CHAFE ARRANGEMENT

BACKGROUND OF THE INVENTION

1. Field of the Invention

This invention relates to chafing gear for boats, and more particularly to a mechanism to prevent anchor lines or mooring lines from chafing and breaking.

2. Prior Art

Watercraft at their moorings or at anchor are constantly being subject to the action of wind and waves against them. The wind and waves and current have a periodicity which causes the mooring line or anchor line to chafe, typically at the chock of the boat, secured at the bow or adjacent to the bow on the gunwale thereof.

The mooring line or anchor line are often reinforced at that location where they enter the chock so as to eliminate or minimize any damage caused by the chafing of that line at that location. Nonetheless, extended periods at an anchoring or mooring, or in violent conditions of a storm, may chafe and cause the failure of the even the best of ropes.

U.S. Pat. No. 3,842,780 to Allens et al. shows a system and method for buoying the end of a wire mooring line to permit the rapid release of that mooring line during an emergency situation. This procedure permits the anchor line to be buoyed for subsequent retrieval upon the boat's escape from the mooring area.

I have discovered an arrangement which will permit a ship or boat to stay on its mooring or anchorage, especially despite the heavy seas or pounding that it may receive from a long and dangerous storm.

It is an object of the present invention to provide an arrangement for maintaining an anchor or mooring line away from chafing areas onboard boats, typically pleasure boats, which mechanism is inexpensive for the boat owner, readily storable, is securable and easily deployable.

BRIEF SUMMARY OF THE INVENTION

The present invention comprises a chafe brake assembly which is deployable from the bow of a boat and is arranged to secure an anchor or mooring line to that boat without chafing or breakage to the line or the boat. The chafe brake assembly is attached to the bow of the boat by a flexible connector, such as a chain or cable. The flexible connector or chain has its proximal end attached to a location near the bow of the boat onto a ring and plate. The length of the connector or chain is preferably about slightly more then 0 to 5 feet. In a preferred embodiment, the chafe brake assembly comprises a housing having a generally U-shaped channel configured thereacross. The channel follows a generally C-shaped path across the housing. The U-shaped channel has a first side wall that has an undercut, angled configuration thereto. The undercut, angled configuration of the side wall of the U-shaped channel is arranged to act as a cam, to permit an anchor line or a mooring line to be wedged therein, the mooring or anchor line being first disposed into the U-shaped channel during the mooring or anchoring procedure, as will be described hereinbelow.

The chafe brake assembly may be arranged as an openable housing, with an uppermost plate and a lower base, each attached by a hinge at a common first or lowermost end. The housing of the chafe brake assembly would also be openable by pivoting about its hinged end to permit a mooring or anchor line to be removed readily from the U-shaped channel, in case it was rigidly wedged therein. The chafe brake assembly would preferably have a fastener extending therethrough to hold the uppermost plate portion of the housing against the lower base portion of the housing.

A cover locking bar would be slidable back and forth over the uppermost plate and across the opening of the U-shaped channel. The cover locking bar would have a slot through which a bolt extends to secure the locking bar to the uppermost plate of the housing. The cover locking bar is engageable with a notch on the opposed side of the U-shaped channel, so as to prevent a line from accidentally falling out from the U-shaped channel.

In operation, the chain, cable or connector line is attached to a ring and plate mounted on, or adjacent to, the bow of the boat. The distal or remaining end of the connector or chain is secured to the chafe brake unit. The anchor line or mooring line is passed through the generally U-shaped channel and brought through the bow chock and secured to a cleat at the bow of the boat. The anchor or mooring line can form a serpentine configuration as it goes through the chafe brake unit from the anchor or mooring to the cleat on the bow of the boat. This nontaut, serpentine configuration of anchor or mooring line eliminates the chafing on that line where it would normally occur at the chock on the bow of the boat. By virtue of the chafe brake assembly swingably moving freely and extending from the bow of the boat, there is no tension on the anchor or mooring line between the chafe brake unit and the bow of the boat. The chain between the chafe brake assembly and the ring plate on the bow absorbs the shock, and the chafe brake assembly is movable, so as to avoid the chafing which would otherwise occur within the anchor or mooring line.

Thus, what has been shown is a unique anti-chafing device for mooring and/or anchor lines, particularly utilizable by pleasure boats. The anti-chafing arrangement permits a standard anchor or mooring line to be utilized with a shuntlike anti-chafing device which removes the possibility of chafing of that anchor or mooring line on the bow of the boat.

The invention thus comprises an anti-chafing device for use with an anchor line attached to a boat. The device comprises a housing arranged to secure a portion of the anchor line and a connector arranged between the housing and the boat, to secure the anchor line and the housing to the boat, whereby force exerted by the anchor line will be transmitted through the housing and the connector to the boat, thereby eliminating chafing on the anchor line by contact with a portion of the boat. The housing can include a curved channel for receipt of the anchor line for gripping the line by the housing. The housing includes a movable locking bar for preventing the anchor line from falling out of the curved channel in the housing. The channel is generally of U-shape in cross section having a wall portion which is undercut to permit the anchor line to be cammed therewithin. The housing has a lower base portion and an uppermost plate portion, the lower base and the uppermost plate portions being hingedly attached to one another at a common first end thereof. The uppermost plate portion has a movable elongated bar disposed thereon. The bar is arranged to slide over the U-shaped channel to prevent an anchor line from uncontrolled escape from the housing. A fastener is arranged through the uppermost plate and the lower base of the housing to maintain the housing portions together. The housing has a notch for receipt of an end of the elongated bar for securement purposes.

The invention also includes a method of eliminating the chafing of an anchor line attached to a boat, comprising the steps of forming a portion of the anchor line into a serpentine configuration which portion is gripped in a housing, securing the housing to the boat by a connector which is shorter than is the serpentine anchor line between the housing and the boat, wedging the anchor line in the housing in a walled channel thereof for securement purposes, splitting the housing into an upper and a lower portion with a hinge at one end thereof to permit the housing to be openable to remove any anchor line wedged tightly therein, and attaching a movable elongated bar to the upper portion of the housing to slide across the channel to prevent any undesired escape of the anchor line therefrom.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
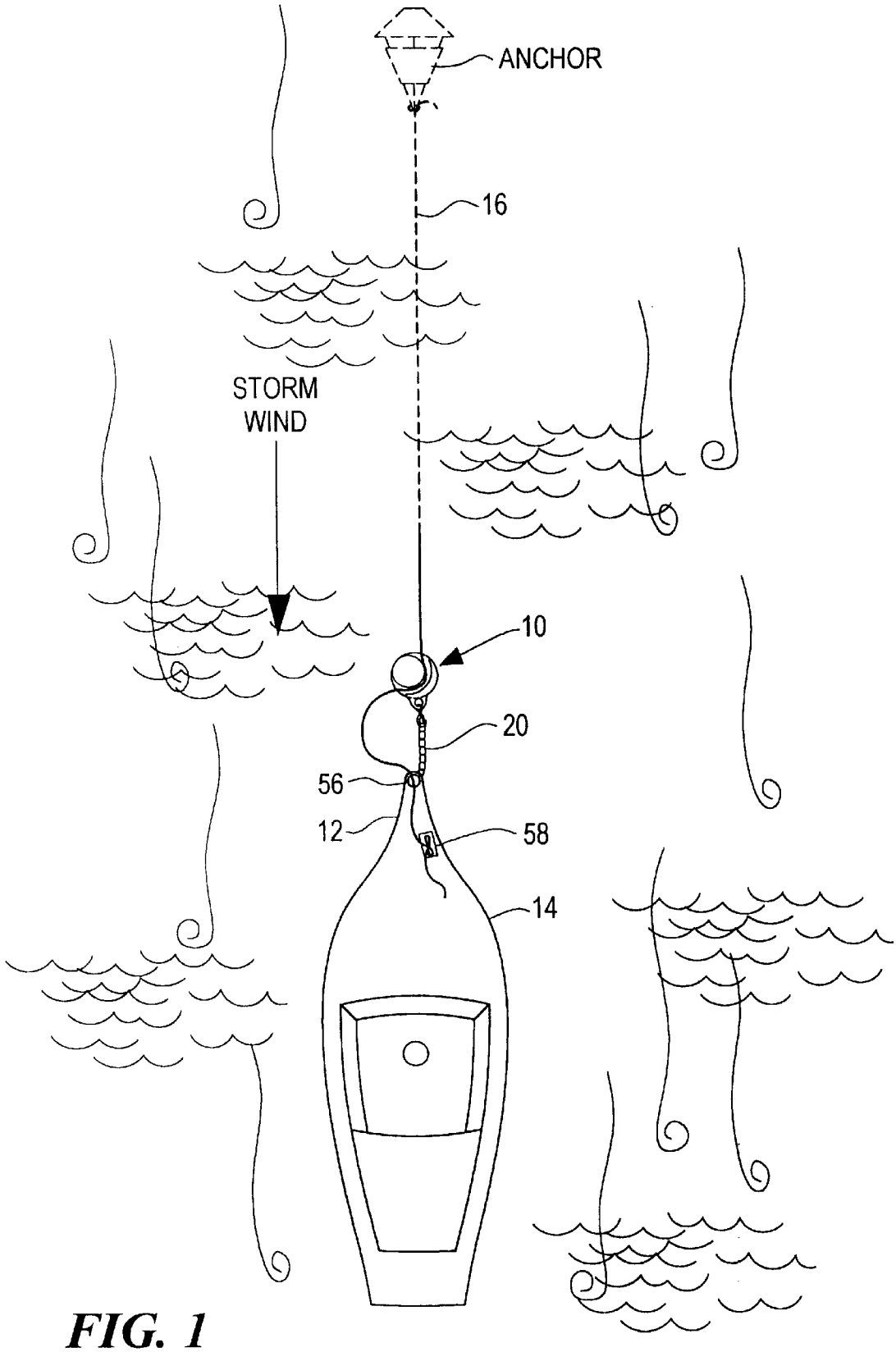
FIG. 1 is a schematic representation of an anchor or mooring line connected to a boat with a chafe brake assembly configured therewith.
Figure 2:
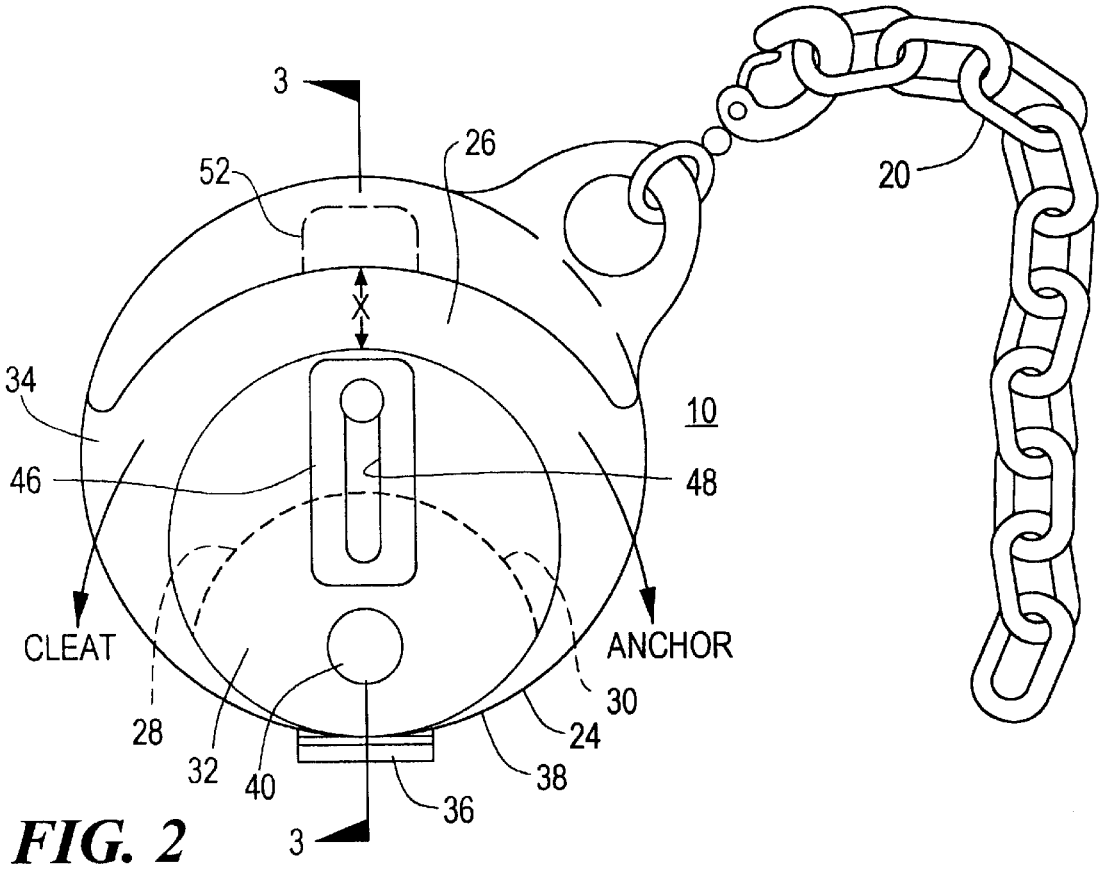
FIG. 2 is a plan view of a chafe brake assembly constructed according to the principles of the present invention.
Figure 2A:
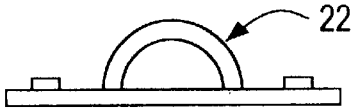
FIG. 2*a* is a side view of a ring and plate for securing a connector to a boat.
Figure 3:
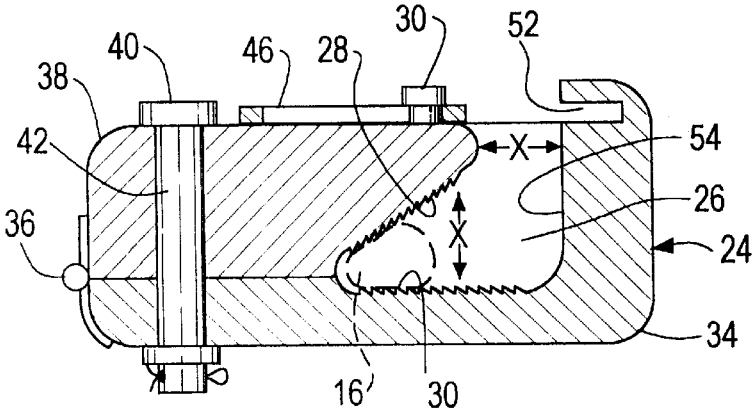
FIG. 3 is a view taken along the lines of 3—3 of FIG. 2.

Referring now to the drawings in detail and particularly to FIG. 1, there is shown the present invention which comprises a chafe brake assembly 10 which is deployable from the bow 12 of a boat 14 and is arranged to secure an anchor or mooring line 16 to that boat 14 without chafing or breakage to that line 16 or boat 14. The chafe brake assembly 10 is attached to the bow of the boat by a flexible connector 20, such as a chain or cable, as may be seen in FIGS. 1 and 2. The flexible connector 20 or chain has its proximal end attached to a location near the bow 12 of the boat 14 onto, for example, a ring and plate 22, as shown in FIG. 2*a*. The length of the connector 20 or chain is preferably about 1–2 feet. The chafe brake assembly 10 comprises a housing 24 having a generally U-shaped channel 26 configured thereacross. The channel 26 follows a generally C-shaped path across the housing 24, as may be seen in FIG. 2. The U-shaped channel 26 has a first side wall 28 with an undercut 30 or angled configuration thereto, as may be seen in FIG. 3. The undercut, angled configuration 30 of the side wall 28 of the U-shaped channel 26 is arranged to act as a cam to permit the anchor or a mooring line 16 to be wedged therein, the mooring or anchor line 16 being first disposed into the U-shaped channel 26 during the mooring or anchoring procedure, as will be described hereinbelow.

The housing 24 of the chafe brake assembly 10 may be openable, with an uppermost plate 32 and a lower base 34, each attached by a hinge 36 at a common first or lowermost end 38. The housing 24 of the chafe brake assembly 10 would also be openable by pivoting about its hinged end 38 to permit a mooring or anchor line 16 to be removed readily from the U-shaped channel 26, in case it was rigidly wedged therein.

The chafe brake assembly 10 would preferably have a bolt-like fastener 40 extending through a bore 42 to hold the uppermost plate portion 32 of the housing 24 against the lower base portion 34 of the housing 24. A cover locking bar 46 would be manually slidable back and forth over the uppermost plate 32 and across the opening of the U-shaped channel. The cover locking bar 32 would have a slot 48 through which cl bolt 50 extends to secure the cover locking bar 32 to the uppermost plate 32 of the housing 24. The cover locking bar 32 is engageable with a notch 52 on the opposed side 54 of the U-shaped channel 26, so as to prevent a line 16 from accidentally falling out from the U-shaped channel 26.

In operation, the chain, cable or connector line 20 is attached to the ring and plate 22 mounted on or adjacent to the bow 12 of the boat 14. The distal or remaining end of the connector or chain 20 is secured to the chafe brake assembly 10. The anchor or mooring line 16 is passed through the generally U-shaped channel 26 and brought through the bow chock 56 and secured to a cleat 58 at the bow 12 of the boat 14. The anchor or mooring line 16 forms a serpentine configuration as it goes through the chafe brake assembly 10, from the anchor or mooring, through the chock 56 and to the cleat 58 on the bow 12 of the boat 14. This nontaut, serpentine configuration of anchor or mooring line 16 eliminates the chafing on that line 16 where it would normally occur, such as at the chock on the bow of the boat.

By virtue of the chafe brake assembly 10 being swingably movable freely and extending from the bow of the boat, there is no tension on the anchor or mooring line 16 between the chafe brake assembly 10 and the bow 12 of the boat 14. The chain 20 between the chafe brake assembly 10 and the ring plate 22 on the bow 12 absorbs the shock, and since the chafe brake assembly 10 is movable, chafing is avoided which would otherwise occur within the anchor or mooring line 16. When it is desired to move from the mooring or anchorage, the chafe brake assembly is pulled toward the bow of the boat and the cover plate slid towards the first end of the housing of the chafe brake assembly. The anchor or mooring line is thus permitted to be lifted from its wedged position in the U-shaped channel of the chafe brake assembly. The anchor may then be pulled aboard, or the mooring line may be uncleared and cast into the water.

Thus, what has been shown is a unique anti-chafing device for mooring and/or anchor lines, particularly utilizable by pleasure boats. The anti-chafing arrangement permits a standard anchor or mooring line to be utilized with a shuntlike anti-chafing device which removes the possibility of chafing of that anchor or mooring line on the bow of the boat.

It is apparent that modifications and improvements may be made within the spirit and scope of the present invention, but is my intention only to be limited by the following claims.

As my invention, I claim:

1. An aniti-chafing device for use with an anchor or mooring line having two ends, one end of which is attached to a boat and the other end of which is attached to an anchor or mooring, said device comprising:

a housing arranged to secure a portion of said line, said housing having a channel disposed therein and at least one camming surface disposed in said channel whereby said camming surface will engage and fixedly hold said line within said channel when a force is exerted by said anchor or mooring; and a connector arranged between said housing and said boat to secure said line and said housing to said boat, whereby force exerted by said anchor or mooring will be transmitted through said housing and said connector to said boat thereby eliminating chafing on said line by said boat.

2. The anti-chafing device as recited in claim 1 wherein said channel is curved for receipt of said anchor line for gripping of said line by said camming surface.

3. The anti-chafing device as recited in claim 2 wherein said housing further includes a movable locking means for preventing said line from falling out of said curved channel in said housing.

4. The anti-chafing device as recited in claim 1 wherein said channel is generally of U-shape in cross section, having a wall portion which is undercut to permit said anchor line to be cammed therewithin.

5. The anti-chafing device as recited in claim 1 wherein said housing has a lower base portion and an uppermost plate portion, said lower base and said uppermost plate portions being hingedly attached to one another at a common first end thereof.

6. The anti-chafing device as recited in claim 5 wherein said uppermost plate portion has a movable elongated means disposed thereon, said means being arranged to slide over said U-shaped channel to prevent said line from uncontrolled escape from said housing.

7. The anti-chafing device as recited in claim 5 including a fastener arranged through said uppermost plate and said lower base of said housing to maintain said housing portions together.

8. The anti-chafing device as recited in claim 6, wherein said housing has a notch for receipt of an end of said elongated bar, for securement purposes.

9. A method of eliminating chafing of a line attached to a boat, comprising the steps of forming a portion of said line into a serpentine configuration which portion is wedged by a camming surface disposed in a housing; and securing said housing to said boat by a connector which is shorter than said serpentine line between said housing and said boat thereby transmitting forces directly from said housing to said boat and not through said line whereby chafing of said line by a surface on said boat is eliminated.

10. The method of eliminating the chafing of an anchor line attached to a boat as recited in claim 9 including the step of splitting said housing into an upper and a lower portion with a hinge at one end thereof to permit said housing to be openable to remove any anchor line wedged tightly therein.

11. The method of eliminating the chafing of an anchor line attached to a boat as recited in claim 9 including the step of attaching a movable elongated bar to said upper portion of said housing to slide across said channel to prevent any undesired escape of said anchor line therefrom.

* * * * *